US007923426B2

(12) United States Patent
Price et al.

(10) Patent No.: US 7,923,426 B2
(45) Date of Patent: Apr. 12, 2011

(54) DETERGENT COMPOSITION

(75) Inventors: Kenneth Nathan Price, Cincinnati, OH (US); Hiroshi Oh, Cincinnati, OH (US); Qing Chen, Beijing (CN); Ming Tang, Beijing (CN); Suxuan Gong, Beijing (CN); Lucia Mendez-Mata, Newcastle Upon Tyne (GB)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 12/475,712

(22) Filed: Jun. 1, 2009

(65) Prior Publication Data

US 2009/0305937 A1 Dec. 10, 2009

(51) Int. Cl.
*C11D 17/00* (2006.01)

(52) U.S. Cl. ..... 510/424; 510/425; 510/426; 510/428; 510/429

(58) Field of Classification Search ..... None
See application file for complete search history.

(56) References Cited

U.S. PATENT DOCUMENTS

| | | | |
|---|---|---|---|
| 4,000,093 | A | 12/1976 | Nicol et al. |
| 4,228,042 | A | 10/1980 | Letton |
| 4,239,660 | A | 12/1980 | Kingry |
| 4,260,529 | A | 4/1981 | Letton |
| 4,430,243 | A | 2/1984 | Bragg |
| 4,483,779 | A | 11/1984 | Llenado et al. |
| 4,483,780 | A | 11/1984 | Llenado |
| 4,565,647 | A | 1/1986 | Llenado |
| 5,188,769 | A | 2/1993 | Connor et al. |
| 5,332,528 | A | 7/1994 | Pan et al. |
| 5,576,282 | A | 11/1996 | Miracle et al. |
| 5,595,967 | A | 1/1997 | Miracle et al. |
| 5,597,936 | A | 1/1997 | Perkins et al. |
| 5,620,952 | A | 4/1997 | Fu et al. |
| 5,783,548 | A | 7/1998 | Fredj et al. |
| 6,004,922 | A | 12/1999 | Watson et al. |
| 6,020,303 | A | 2/2000 | Cripe et al. |
| 6,022,844 | A | 2/2000 | Baillely et al. |
| 6,093,856 | A | 7/2000 | Cripe et al. |
| 6,136,769 | A | 10/2000 | Asano et al. |
| 6,150,322 | A | 11/2000 | Singleton et al. |
| 6,153,577 | A | 11/2000 | Cripe et al. |
| 6,221,825 | B1 | 4/2001 | Williams, Jr. et al. |
| 6,225,464 | B1 | 5/2001 | Hiler, II et al. |
| 6,306,812 | B1 | 10/2001 | Perkins et al. |
| 6,326,348 | B1 | 12/2001 | Vinson et al. |
| 6,482,994 | B2 | 11/2002 | Scheper et al. |
| 7,501,389 | B2 | 3/2009 | Hage et al. |

FOREIGN PATENT DOCUMENTS

| | | | |
|---|---|---|---|
| WO | WO 92/06162 | | 4/1992 |
| WO | WO 97/34994 | A1 | 9/1997 |
| WO | WO 98/20105 | A1 | 5/1998 |
| WO | WO 98/33503 | | 8/1998 |
| WO | WO 98/33504 | | 8/1998 |
| WO | WO 98/33505 | | 8/1998 |
| WO | WO 98/33506 | | 8/1998 |
| WO | WO 98/35002 | | 8/1998 |
| WO | WO 00/18856 | A1 | 4/2000 |
| WO | WO 00/47708 | | 8/2000 |
| WO | WO 01/42408 | | 6/2001 |

OTHER PUBLICATIONS

PCT International Search Report, dated Sep. 11, 2009—7 pgs.

*Primary Examiner* — Necholus Ogden, Jr.
(74) *Attorney, Agent, or Firm* — Julie A. McConihay; Leonard W. Lewis; Steven W. Miller

(57) ABSTRACT

A detergent composition comprising:

a non-sulphated anionic surfactant, alkyl sulphate surfactant(s) of formula $R_2$—O—$SO_3^-M^+$, with $R_2$ being a linear or branched, substituted or unsubstituted, optionally alkoxylated, $C_6$-$C_{18}$ alkyl and with $M^+$ being a proton or a cation which provides charge neutrality, and wherein the alkyl sulphate surfactant(s) of formula $R_2$—O—$SO_3^-M^+$, comprises from 85% to 100% by weight of alkyl sulphate surfactant(s) of formula $R_1$—O—$SO_3^-M^+$, with $R_1$ being a linear or branched, substituted or unsubstituted, optionally alkoxylated, $C_6$-$C_{14}$ alkyl and with $M^+$ being a proton or a cation which provides charge neutrality, wherein the composition comprises from 0 to 20% of zeolite, and wherein the composition does not comprise from 40% to 43% by weight of sodium chloride.

20 Claims, No Drawings

DETERGENT COMPOSITION

FIELD OF THE INVENTION

The present invention relates to detergent compositions with enhanced cleaning properties comprising a surfactant system with improved hardness tolerance. The detergent compositions of the present invention comprise a non-sulphated anionic surfactant and an alkyl sulphate surfactant and are in particular suitable for use in laundry detergent compositions or other fabric-treatment compositions.

BACKGROUND OF THE INVENTION

Anionic surfactants are known for their cleaning detergent properties and, accordingly, have been used for years in laundry detergent compositions to remove the soil of the fabrics during the washes.

The cleaning properties of anionic surfactants may be influenced by several parameters, such as the type of soil, the water hardness, or the formulation of the detergent composition as a whole.

In order to obtain good cleaning properties of the anionic surfactants in a broad range of washes, the detergent composition may also comprise surfactants, builders, or other additives. Such compounds may in particular aim at reducing the water hardness of the wash or at improving the hardness tolerance of the surfactant system.

The Inventors have now surprisingly found that a specific class of alkyl sulphate surfactant(s) could improved the hardness tolerance of the surfactant system of a detergent composition, in particular a detergent composition comprising a non-sulphated anionic surfactant. This specific class of alkyl sulphate surfactant(s) may also improve the cleaning properties of the detergent composition.

SUMMARY OF THE INVENTION

In one embodiment of the present invention, the invention concerns a detergent composition comprising:

a non-sulphated anionic surfactant, alkyl sulphate surfactant(s) of formula $R_2—O—SO_3^-M^+$, wherein the alkyl sulphate surfactant(s) of formula $R_2—O—SO_3^-M^+$ comprise(s) from 85% to 100% by weight of alkyl sulphate surfactant(s) of formula $R_1—O—SO_3^-M^+$, with $R_2$, $R_1$ and $M^+$ being as defined below, wherein the composition comprises from 0 to 20% of zeolite, and The composition may not comprise from 41.10% to 41.20% by weight of sodium chloride or from 52.25% to 52.35% or from 59.20% to 59.30% by weight of sodium sulphate.

The present invention also concerns the use of alkyl sulphate surfactant(s) of formula $R_2—O—SO_3^-M^+$ comprising from 85% to 100% by weight of alkyl sulphate surfactant(s) of formula $R_1—O—SO_3^-M^+$, with $R_2$, $R_1$ and $M^+$ being as defined below, to increase the hardness tolerance of the surfactant system of a detergent composition, in particular a detergent composition comprising a non-sulphated anionic surfactant.

Surprisingly, the Inventors have found that the alkyl sulphate surfactant(s) of the invention could also improve the creaminess of the composition. As such, the present invention concerns the use of alkyl sulphate surfactant(s) of formula $R_2—O—SO_3^-M^+$ comprising from 85% to 100% by weight of alkyl sulphate surfactant(s) of formula $R_1—O—SO_3^-M^+$, with $R_2$, $R_1$ and $M^+$ being as defined below, to increase the creaminess properties of a detergent composition, in particular a detergent composition comprising a non-sulphated anionic surfactant.

The invention also concerns a process to prepare a detergent composition, in particular a detergent composition comprising a non-sulphated anionic surfactant, comprising the following step:

separating from a mixture of alkyl sulphate surfactants of formula $R_2—O—SO_3^-M^+$ (or the corresponding alcohols) comprising less than 85% by weight of alkyl sulphate surfactant(s) of formula $R_1—O—SO_3^-M^+$ (or the corresponding alcohols), alkyl sulphate surfactant(s) of formula $R_2—O—SO_3^-M^+$ (or the corresponding alcohol(s)) comprising from 85% to 100% by weight of alkyl sulphate surfactant(s) of formula $R_1—O—SO_3^-M^+$ (or the corresponding alcohol(s)), wherein $R_2$, $R_1$ and $M^+$ are as defined below.

The detergent composition may comprise less than 40%, in particular less than 30% or 20% or 20% or even less than 5% of sodium chloride and/or of sodium sulphate.

DETAILED DESCRIPTION OF THE INVENTION

Surfactant System

The composition of the invention comprises a surfactant system constituted of surfactant(s).

The composition may comprise from 1 to 50% by weight of the composition of a surfactant system. In particular, the composition comprises from 2 to 40, typically from 4 to 30, for example from 6 to 25 or from 8 to 20% by weight of a surfactant system. The composition may comprise less than 15%, for example less than 12%, or even less than 10% by weight of a surfactant system.

The surfactant system comprises at least:

a non-sulphated anionic surfactant, alkyl sulphate surfactant(s) of formula $R_2—O—SO_3^-M^+$ comprising from 85% to 100% by weight of alkyl sulphate surfactant(s) of formula $R_1—O—SO_3^-M^+$, with $R_1$, $R_2$, and $M^+$ being as defined below.

Alkyl Sulphate Surfactant(s)

The detergent composition of the invention comprises alkyl sulphate surfactant(s) of formula $R_2—O—SO_3^-M^+$, with $R_2$ being a linear or branched, typically linear, substituted or unsubstituted, typically unsubstituted, optionally alkoxylated, $C_6$-$C_{18}$ alkyl and with $M^+$ being a proton or a cation which provides charge neutrality.

The composition may comprise from 0.1 to 50%, for example from 0.5 to 10%, typically from 1 to 6%, or from 2 to 5% by weight of alkyl sulphate surfactant(s) of formula $R_2—O—SO_3^-M^+$.

The detergent composition of the invention comprises alkyl sulphate surfactant(s) of formula $R_1—O—SO_3^-M^+$, with $R_1$ being a linear or branched, typically linear, substituted or unsubstituted, typically unsubstituted, optionally alkoxylated, $C_6$-$C_{14}$ alkyl and with $M^+$ being a proton or a cation which provides charge neutrality.

The composition may comprise from 0.1 to 50%, for example from 0.5 to 10%, typically from 1 to 6%, or from 2 to 5% by weight of alkyl sulphate surfactant(s) of formula $R_1—O—SO_3^-M^+$.

In the composition of the invention, the alkyl sulphate surfactant(s) of formula $R_2—O—SO_3^-M^+$, comprise(s) from 85% to 100% by weight of alkyl sulphate surfactant(s) of formula $R_1—O—SO_3^-M^+$. In the composition of the invention, typically, the alkyl sulphate surfactant(s) of formula $R_2—O—SO_3^-M^+$, comprises from 90 to 100%, in particular at least 92% or 94%, typically at least 96% or 98%, by weight of alkyl sulphate surfactant(s) of formula $R_1$—O—$SO_3^-M^+$.

In the composition of the invention, the alkyl sulphate surfactant(s) of formula $R_2$—O—$SO_3^-M^+$, may comprise from 30% to 100%, for example from 50 to 99%, typically from 60 to 95%, or from 65 to 90%, or even from 70 to 80% by weight of alkyl sulphate surfactant(s) of formula $R_{12}$—O—$SO_3^-M^+$, with $R_{12}$ being a linear or branched, typically linear, substituted or unsubstituted, typically unsubstituted, optionally alkoxylated, $C_{12}$ alkyl and with $M^+$ being a proton or a cation which provides charge neutrality.

In the composition of the invention, the alkyl sulphate surfactant(s) of formula $R_2$—O—$SO_3^-M^+$, may comprise from 10% to 100%, or from 20 to 50%, or even from 25 to 30% by weight of alkyl sulphate surfactant(s) of formula $R_{14}$—O—$SO_3^-M^+$ with $R_{14}$ being a linear or branched, typically linear, substituted or unsubstituted, typically unsubstituted, optionally alkoxylated, $C_{14}$ alkyl and with $M^+$ being a proton or a cation which provides charge neutrality.

According to one embodiment of the invention, the alkyl sulphate surfactant(s) of formula $R_2$—O—$SO_3^-M^+$ or $R_1$—O—$SO_3^-M^+$ are not alkoxylated. The compositions of the invention may also comprise both non alkoxylated and alkoxylated alkyl sulphate surfactants of formula $R_2$—O—$SO_3^-M^+$ or $R_1$—O—$SO_3^-M^+$. The compositions may comprise at least two alkoxylated sulphate surfactant(s) of formula $R_2$—O—$SO_3^-M^+$ or $R_1$—O—$SO_3^-M^+$ alkoxylated with different degree of alkoxylation. The alkoxylated alkyl sulphate surfactant(s) of formula $R_2$—O—$SO_3^-M^+$ or $R_1$—O—$SO_3^-M^+$ may be alkoxylated with 0.1 to 9 moles or from 0.1 to 3, or from 0.2 to 1.5, typically from 0.3 to 0.9 moles of $C_{1-4}$ alkylene oxide per mole of alkyl sulphate.

$M^+$ may be a proton or a cation such as a sodium, calcium, potassium, or magnesium cation, in particular a sodium cation.

Preferred alkyl sulphate surfactant(s) of formula $R_1$—O—$SO_3^-M^+$ are selected from $C_{6-14}$ alkyl sulphate surfactant(s), in particular $C_{8-14}$, $C_{10-14}$, or even $C_{12-14}$ alkyl sulphate surfactant(s).

The alkyl sulphate surfactant(s) of formula $R_2$—O—$SO_3^-M^+$ or $R_1$—O—$SO_3^-M^+$ may comprise more than 50%, in particular more than 60%, for example more than 70%, typically more than 80 or 90%, or substantially 100% of alkyl sulphate surfactant(s) having an alkyl chain comprising an even number of carbon atoms.

The alkyl sulphate surfactant(s) of formula $R_2$—O—$SO_3^-M^+$ or $R_1$—O—$SO_3^-M^+$ may be obtained by the sulfonation of the corresponding alcohol(s). The required carbon chain length distribution can be obtained by using alcohols with the corresponding chain length distribution prepared synthetically or from natural raw materials or corresponding pure starting compounds.

Typically, the alkyl sulphate surfactant(s) of formula $R_2$—O—$SO_3^-M^+$ or $R_1$—O—$SO_3^-M^+$ may be derived from palm kernel oil or coconut oil. Palm kernel oil and coconut oil usually comprises triglycerides which can be chemically processed to obtain a mixture of $C_{12}$-$C_{18}$ alcohols which usually comprise more than 20% of $C_{16}$-$C_{18}$ alcohols. The alcohols may be sulphated to obtain alkyl sulphates. A mixture of alkyl sulphates comprising a lower proportion of $C_{16}$-$C_{18}$ alkyl sulphates may be obtained by separating the corresponding alcohols before the sulphatation step or by separating the obtained alkyl sulphate surfactant(s) after the sulphatation step.

A Suitable alkyl sulphate surfactant(s) of formula $R_2$—O—$SO_3^-M^+$ is Texapon v95 by Cognis.

Non-Sulphated Anionic Surfactant,

The detergent composition of the invention comprises a non-sulphated anionic surfactant in particular a non-sulphated anionic surfactant having a HLB value of less than 35. A non-sulphated anionic surfactant is an anionic surfactant which does not comprise a sulphate moiety. The detergent composition may comprise a non-sulphated anionic surfactant having a HLB value of less than 30, in particular of less than 25, for example a HLB value of from 5 to 20, typically from 8 to 17, or from 10 to 15, typically from 11 to 14, or from 12 to 13.

The composition may comprise from 1 to 50% by weight of the composition of non-sulphated anionic surfactant(s). In particular, the composition comprises from 2 to 30, typically from 4 to 20, for example from 6 to 16 or from 8 to 14% by weight of non-sulphated anionic surfactant(s). The composition may comprise less than 12%, for example less than 10%, or even less than 9% by weight of non-sulphated anionic surfactant(s).

The HLB value corresponds to the hydrophilic-lipophilic balance. HLB values may be calculated or determined by a variety of known procedures, such as those described in "Surfactants and Interfacial Phenomena" by Milton J. Rosen, John Wiley and Son, New York, N.Y., page 244 (1978) and "Interfacial Phenomena" by J. T. Davies and E. K. Rideal, Academic Press, 2nd Edition, pp 373-383 (1963).

Preferred non-sulphated anionic surfactants typically comprise one or more moieties selected from the group consisting of carbonate, phosphate, phosphonate, sulphonate, carboxylate and mixtures thereof, and in particular sulphonate.

The non-sulphated anionic surfactant may be an arylalkylsulfonate and may in particular be selected from the group consisting of linear or branched, substituted or unsubstituted, $C_{10-13}$ alkylbenzene sulphonates, typically linear $C_{10-13}$ alkylbenzene sulphonates; linear or branched, substituted or unsubstituted, $C_{8-18}$ alkyl sulphonates; and mixtures thereof.

Typically, the non-sulphated anionic surfactant is a linear $C_{10-13}$ alkylbenzene sulphonate. The linear $C_{10-13}$ alkylbenzene sulphonates may be obtained, by sulphonating commercially available linear alkyl benzenes (LAB); suitable LAB include low 2-phenyl LAB, such as those supplied by Sasol under the tradename Isochem® or those supplied by Petresa under the tradename Petrelab®, other suitable LAB include high 2-phenyl LAB, such as those supplied by Sasol under the tradename Hyblene®.

The non-sulphated anionic surfactant may be a $C_{8-18}$ alkyl sulphonate linear or branched, optionally condensed with from 1 to 9 moles of $C_{1-4}$ alkylene oxide per mole of $C_{8-18}$ alkyl sulphonate. In particular, the $C_{8-18}$ alkyl sulphonate is a linear or branched, substituted or unsubstituted, $C_{12-18}$ alkyl alkoxylated sulphonate having an average degree of alkoxylation of from 1 to 35, typically from 3 to 7.

The weight ratio of alkyl sulphate surfactant(s) of formula $R_2$—O—$SO_3^-M^+$ to non-sulphated anionic surfactant of the detergent composition may be comprised between 0.02 and 1, for example from 0.05 to 0.5, or from 0.1 to 0.2.

The weight ratio of alkyl sulphate surfactant(s) of formula $R_1$—O—$SO_3^-M^+$ to non-sulphated anionic surfactant of the detergent composition may be comprised between 0.02 and 1, for example from 0.05 to 0.5, or from 0.1 to 0.2.

When the detergent composition is in particulate form, the non-sulphated anionic surfactant and the alkyl sulphate surfactant(s) of formula $R_2$—O—$SO_3^-M^+$ may be in the same detergent particles or in separate detergent particles. Typically, the non-sulphated anionic surfactant and the alkyl sulphate surfactant(s) of formula $R_2$—O—$SO_3^-M^+$ are in the same particle.

The number of carbon atoms of the alkyl chain length of the non-sulphated anionic surfactant may be comprised between 8 and 18, in particular comprised between 10 and 15 or between 11 and 13.

Typically, the difference between the average carbon chain length $R_2$ of the alkyl sulphate surfactant(s) and the number of carbon atoms in the alkyl chain length of the non-sulphated anionic surfactant is comprised between 0 and 4 carbon atoms, in particular is comprised between 0 and 2 carbon atoms or between 0 and 1 carbon atoms.

The inventors have discovered that the combination of alkyl sulphate surfactant(s) and non-sulphated anionic surfactant(s) having alkyl chain of similar length further increased the hardness tolerance of the surfactant system.

Other Surfactant of the Surfactant System

In addition to the non-sulphated anionic surfactant(s) and the alkyl sulphate surfactant(s) of formula $R_2$—O—$SO_3^-M^+$ the composition may comprise one or more additional surfactant(s). The additional surfactant(s) may be selected from nonionic surfactants, other anionic surfactants, cationic surfactants, ampholytic surfactants, zwitterionic surfactants, semi-polar nonionic surfactants and mixtures thereof.

NON-IONIC DETERSIVE SURFACTANT—The compositions of the invention may comprise non-ionic surfactant. Where present the non-ionic detersive surfactant(s) is generally present in amounts of from 0.5 to 2 wt %, or from 2 wt % to 4 wt %.

The non-ionic detersive surfactant can be selected from the group consisting of: alkyl polyglucoside and/or an alkyl alkoxylated alcohol; $C_{12}$-$C_{18}$ alkyl ethoxylates, such as, NEODOL® non-ionic surfactants from Shell; $C_6$-$C_{12}$ alkyl phenol alkoxylates wherein the alkoxylate units are ethyleneoxy units, propyleneoxy units or a mixture thereof; $C_{12}$-$C_{18}$ alcohol and $C_6$-$C_{12}$ alkyl phenol condensates with ethylene oxide/propylene oxide block polymers such as Pluronic® from BASF; $C_{14}$-$C_{22}$ mid-chain branched alcohols, BA, as described in more detail in U.S. Pat. No. 6,150,322; $C_{14}$-$C_{22}$ mid-chain branched alkyl alkoxylates, BAEx, wherein x=from 1 to 35, as described in more detail in U.S. Pat. No. 6,153,577, U.S. Pat. No. 6,020,303 and U.S. Pat. No. 6,093,856; alkylcelluloses as described in more detail in U.S. Pat. No. 4,565,647, specifically alkylpolyglycosides as described in more detail in U.S. Pat. No. 4,483,780 and U.S. Pat. No. 4,483,779; polyhydroxy fatty acid amides as described in more detail in U.S. Pat. No. 5,332,528, WO 92/06162, WO 93/19146, WO 93/19038, and WO 94/09099; ether capped poly(oxyalkylated) alcohol surfactants as described in more detail in U.S. Pat. No. 6,482,994 and WO 01/42408; and mixtures thereof.

CATIONIC DETERSIVE SURFACTANT—The composition may comprise a cationic detersive surfactant. When present, typically the composition comprises from 0.1 wt % to 10 wt %, or from 1 wt % to 2 wt % cationic detersive surfactant.

Suitable cationic detersive surfactants are alkyl pyridinium compounds, alkyl quaternary ammonium compounds, alkyl quaternary phosphonium compounds, and alkyl ternary sulphonium compounds. The cationic detersive surfactant can be selected from the group consisting of: alkoxylate quaternary ammonium (AQA) surfactants as described in more detail in U.S. Pat. No. 6,136,769; dimethyl hydroxyethyl quaternary ammonium surfactants as described in more detail in U.S. Pat. No. 6,004,922; polyamine cationic surfactants as described in more detail in WO 98/35002, WO 98/35003, WO 98/35004, WO 98/35005, and WO 98/35006; cationic ester surfactants as described in more detail in U.S. Pat. No. 4,228,042, U.S. Pat. No. 4,239,660, U.S. Pat. No. 4,260,529 and U.S. Pat. No. 6,022,844; amino surfactants as described in more detail in U.S. Pat. No. 6,221,825 and WO 00/47708, specifically amido propyldimethyl amine; and mixtures thereof.

Highly preferred cationic detersive surfactants are mono-$C_{8-10}$ alkyl mono-hydroxyethyl di-methyl quaternary ammonium chloride, mono-$C_{10-12}$ alkyl mono-hydroxyethyl di-methyl quaternary ammonium chloride and mono-$C_{10}$ alkyl mono-hydroxyethyl di-methyl quaternary ammonium chloride. Cationic surfactants such as Praepagen HY (tradename Clariant) may be useful and may also be useful as a suds booster.

Hardness Tolerance

The surfactant system of the present invention is showing improved hardness tolerance. The hardness tolerance of a surfactant system may be measured as follow.

HARDNESS TOLERANCE TEST—All glassware used is cleaned and dried thoroughly. The sample concentrations used are based on the anhydrous form of the surfactant system of the present invention. The experiment is run at 22±1° C.

A 20 g surfactant solution containing 4500 ppm of the surfactant system for which the Hardness Tolerance is to be measured, 3210 ppm sodium tripolyphosphate, 3860 ppm sodium carbonate, and 13200 ppm sodium sulphate is prepared by dissolving each component in de-ionized water at the indicated concentrations. The 20 g surfactant solution is added to 180 g of a 4.7677 mmol/L (27.8 grain per gallon), 3:molar ratio $Ca^{2+}$:$Mg^{2+}$ hardness solution (prepared from the corresponding sulphate salts). The resulting 200 g test solution is shaken vigorously for 30 seconds and then allowed to stand. After 40 minutes, a 10 mL aliquot of the test solution is filtered through a 0.1 μM Gelman Acrodisk syringe filter (VWR Scientific, cat. no. 28143-309). The first 2 mL of the filtrate are discarded and the remaining 8 mL of the filtrate are collected for analysis. The surfactant concentration (in ppm) in the collected filtrate, Csurf, is then measured quantitatively by a suitable analytical technique, e.g., a two-phase titration such as the international standard method ISO 2271 described in Introduction To Surfactant Analysis; Cullum, D. C., Ed.; Blackie Academic and Professional, Glasgow, 1994; pp 59-64.

The hardness tolerance result in this test is expressed as the % loss of the surfactant system being tested according to the following formula:

$$\%\ \text{loss}=([450\ \text{ppm}-C\text{surf}(\text{ppm})]\div 450\ \text{ppm})\times 100\%$$

A smaller % loss indicates a higher hardness tolerance.

Suds Creaminess

The surfactant system of the present invention provides suds with improved creaminess. Improved creaminess may correspond to a smaller average by number bubble size.

Builder

The detergent composition may comprise one or more builders. When a builder is used, the subject composition will typically comprise from 1% to about 40%, typically from 2 to 25%, or even from about 5% to about 20%, or from 8 to 15% by weight of builder.

The detergent compositions of the present invention comprise from 0 to 20%, in particular less than 15% or 10%, for example less than 5% of zeolite. In particular, the detergent composition comprises from 0 to 20%, in particular less than 15% or 10%, for example less than 5% of aluminosilicate builder(s).

The detergent composition of the present invention may comprise from 0 to 20%, in particular less than 15% or 10%, for example less than 5% of phosphate builder and/or silicate builder and/or zeolite builder.

The detergent compositions of the present invention may comprise from 0 to 20%, in particular less than 15% or 10%, for example less than 5% of sodium carbonate.

Builders include, but are not limited to, the alkali metal, ammonium and alkanolammonium salts of polyphosphates, alkali metal silicates, layered silicates, such as SKS-6 of Clariant®, alkaline earth and alkali metal carbonates, aluminosilicate builders, such as zeolite, and polycarboxylate compounds, ether hydroxypolycarboxylates, copolymers of maleic anhydride with ethylene or vinyl methyl ether, 1,3,5-trihydroxy benzene-2,4,6-trisulphonic acid, and carboxymethyloxysuccinic acid, fatty acids, the various alkali metal, ammonium and substituted ammonium salts of polyacetic acids such as ethylenediamine tetraacetic acid and nitrilotriacetic acid, as well as polycarboxylates such as mellitic acid, succinic acid, citric acid, oxydisuccinic acid, polymaleic acid, benzene 1,3,5-tricarboxylic acid, carboxymethyloxysuccinic acid, and soluble salts thereof.

The total amount of phosphate builder(s), aluminosilicate builder(s), polycarboxylic acid builder(s), and additional silicate builder(s) in the detergent composition may be comprised from 0 to 25%, or even from 1 to 20%, in particular from 1 to 15%, especially from 2 to 10%, for example from 3 to 5%, by weight.

The composition may further comprise any other supplemental builder(s), chelant(s), or, in general, any material which will remove calcium ions from solution by, for example, sequestration, complexation, precipitation or ion exchange. In particular the composition may comprise materials having at a temperature of 25° C. and at a 0.1M ionic strength a calcium binding capacity of at least 50 mg/g and a calcium binding constant log K $Ca^{2+}$ of at least 3.50.

In the composition of the invention, the total amount of phosphate builder(s), aluminosilicate builder(s), polycarboxylic acid builder(s), additional silicate builder(s), and other material(s) having a calcium binding capacity superior to 50 mg/g and a calcium binding constant higher than 3.50 in the composition may be comprised from 0 to 25%, or even from 1 to 20%, in particular from 1 to 15%, especially from 2 to 10%, for example from 3 to 5%, by weight.

Adjunct Components

The detergent composition may comprise additional adjunct components. The precise nature of these additional adjunct components, and levels of incorporation thereof, will depend on the physical form of the composition and the nature of the operation for which it is to be used. Suitable adjunct materials include, but are not limited to, flocculating aid, chelating agents, dye transfer inhibitors, enzymes, enzyme stabilizers, catalytic materials, bleach activators, hydrogen peroxide, sources of hydrogen peroxide, preformed peracids, polymeric dispersing agents, clay soil removal/anti-redeposition agents, brighteners, suds suppressors, dyes, perfumes, structure elasticizing agents, fabric softeners, carriers, hydrotropes, processing aids, and/or pigments. In addition to the disclosure below, suitable examples of such other adjuncts and levels of use are found in U.S. Pat. Nos. 5,576,282, 6,306,812 B1 and 6,326,348 B1 that are incorporated by reference. Such one or more adjuncts may be present as detailed below:

FLOCCULATING AID—The composition may further comprise a flocculating aid. Typically, the composition comprises at least 0.3% by weight of the composition of a flocculating aid. The composition may also be substantially free of flocculating aid. Typically, the flocculating aid is polymeric. Typically the flocculating aid is a polymer comprising monomer units selected from the group consisting of ethylene oxide, acrylamide, acrylic acid and mixtures thereof. Typically the flocculating aid is a polyethyleneoxide. Typically the flocculating aid has a molecular weight of at least 100,000 Da, in particular from 150,000 Da to 5,000,000 Da or even from 200,000 Da to 700,000 Da.

BLEACHING AGENT—The compositions of the present invention may comprise one or more bleaching agents. In general, when a bleaching agent is used, the compositions of the present invention may comprise from about 0.1% to about 50% or even from about 0.1% to about 25% bleaching agent by weight of the subject detergent composition. When present, suitable bleaching agents include bleaching catalysts, photobleaches for example Vitamin K3 and zinc or aluminium phtalocyanine sulfonate; bleach activators such as tetraacetyl ethylene diamine (TAED) and nonanoyloxybenzene sulphonate (NOBS); hydrogen peroxide; pre-formed peracids; sources of hydrogen peroxide such as inorganic perhydrate salts, including alkali metal salts such as sodium salts of perborate (usually mono- or tetra-hydrate), percarbonate, persulphate, perphosphate, persilicate salts and mixtures thereof, optionally coated, suitable coatings including inorganic salts such as alkali metal; and mixtures thereof.

The amounts of hydrogen peroxide source and peracid or bleach activator may be selected such that the molar ratio of available oxygen (from the peroxide source) to peracid is from 1:1 to 35:1, or even 2:1 to 10:1

FLUORESCENT WHITENING AGENT—The composition may contain components that may tint articles being cleaned, such as fluorescent whitening agent. When present, any fluorescent whitening agent suitable for use in a detergent composition may be used in the composition of the present invention. The most commonly used fluorescent whitening agents are those belonging to the classes of diaminostilbene-sulphonic acid derivatives, diarylpyrazoline derivatives and bisphenyl-distyryl derivatives.

Typical fluorescent whitening agents are Parawhite KX, supplied by Paramount Minerals and Chemicals, Mumbai, India; Tinopal® DMS and Tinopal® CBS available from Ciba-Geigy AG, Basel, Switzerland. Tinopal® DMS is the disodium salt of 4,4'-bis-(2-morpholino-4 anilino-s-triazin-6-ylamino)stilbene disulphonate. Tinopal® CBS is the disodium salt of 2,2'-bis-(phenyl-styryl)disulphonate.

FABRIC HUEING AGENTS—Fluorescent whitening agents emit at least some visible light. In contrast, fabric hueing agents alter the tint of a surface as they absorb at least a portion of the visible light spectrum. Suitable fabric hueing agents include dyes and dye-clay conjugates, and may also include pigments. Suitable dyes include small molecule dyes and polymeric dyes. Suitable small molecule dyes include small molecule dyes selected from the group consisting of dyes falling into the Colour Index (C.I.) classifications of Direct Blue, Direct Red, Direct Violet, Acid Blue, Acid Red, Acid Violet, Basic Blue, Basic Violet and Basic Red, or mixtures thereof.

POLYMERIC DISPERSING AGENTS—the compositions of the present invention can contain additional polymeric dispersing agents. These polymeric dispersing agents, if included, are typically at levels up to about 5%, typically from about 0.2% to about 2.5%, more typically from about 0.5% to about 1.5%. Suitable polymeric dispersing agents, include polymeric polycarboxylates, substituted (including quarternized and oxidized) polyamine polymers, and polyethylene glycols, such as: acrylic acid-based polymers having an average molecular of about 2,000 to about 10,000; acrylic/maleic-based copolymers having an average molecular weight of about 2,000 to about 100,000 and a ratio of acrylate to maleate segments of from about 30:1 to about 1:1; maleic/acrylic/vinyl alcohol terpolymers; polyethylene glycol (PEG)

having a molecular weight of about 500 to about 100,000, typically from about 1,000 to about 50,000, more typically from about 1,500 to about 10,000; and water soluble or dispersible alkoxylated polyalkyleneamine materials.

POLYMERIC SOIL RELEASE AGENT—The compositions of the present invention can also contain polymeric soil release agent. polymeric soil release agent, or "SRA", have hydrophilic segments to hydrophilize the surface of hydrophobic fibers such as polyester and nylon, and hydrophobic segments to deposit upon hydrophobic fibers and remain adhered thereto through completion of washing and rinsing cycles, thereby serving as an anchor for the hydrophilic segments. This can enable stains occurring subsequent to treatment with the SRA to be more easily cleaned in later washing procedures. Preferred SRA's include oligomeric terephthalate esters; sulfonated product of a substantially linear ester oligomer comprised of an oligomeric ester backbone of terephthaloyl and oxyalkyleneoxy repeat units and allyl-derived sulfonated terminal moieties covalently attached to the backbone; nonionic end-capped 1,2-propylene/polyoxyethylene terephthalate polyesters; an oligomer having empirical formula $(CAP)_2$ $(EG/PG)_5$ $(T)_5$ $(SIP)_1$ which comprises terephthaloyl (T), sulfoisophthaloyl (SIP), oxyethyleneoxy and oxy-1,2-propylene (EG/PG) units and which is typically terminated with end-caps (CAP), typically modified isethionates, as in an oligomer comprising one sulfoisophthaloyl unit, 5 terephthaloyl units, oxyethyleneoxy and oxy-1,2-propyleneoxy units in a defined ratio, typically about 0.5:1 to about 10:1, and two-end-cap units derived from sodium 2-(2-hydroxyethoxy)-ethanesulfonate; oligomeric esters comprising: (1) a backbone comprising (a) at least one unit selected from the group consisting of dihydroxy sulfonates, polyhydroxy sulfonates, a unit which is at least trifunctional whereby ester linkages are formed resulting in a branched oligomer backbone, and combinations thereof; (b) at least one unit which is a terephthaloyl moiety; and (c) at least one unsulfonated unit which is a 1,2-oxyalkyleneoxy moiety; and (2) one or more capping units selected from nonionic capping units, anionic capping units such as alkoxylated, typically ethoxylated, isethionates, alkoxylated propanesulfonates, alkoxylated propanedisulfonates, alkoxylated phenolsulfonates, sulfoaroyl derivatives and mixtures thereof. Preferred are esters of the empirical formula:

$$((CAP)_a(EG/PG)_b(DEG)_cPEG)_d(T)_e(SIP)_f(SEG)_g(B)_h)$$

wherein CAP, EG/PG, PEG, T and SIP are as defined hereinabove, DEG represents di(oxyethylene)oxy units, SEG represents units derived from the sulfoethyl ether of glycerin and related moiety units, B represents branching units which are at least trifunctional whereby ester linkages are formed resulting in a branched oligomer backbone, a is from about 1 to about 12, b is from about 0.5 to about 25, c is from 0 to about 12, d is from 0 to about 10, b+c+d totals from about 0.5 to about 25, e is from about 1.5 to about 25, f is from 0 to about 12; e+f totals from about 1.5 to about 25, g is from about 0.05 to about 12; h is from about 0.01 to about 10, and a, b, c, d, e, f, g, and h represent the average number of moles of the corresponding units per mole of the ester; and the ester has a molecular weight ranging from about 500 to about 5,000; and; cellulosic derivatives such as the hydroxyether cellulosic polymers available as METHOCEL® from Dow; the $C_1$-$C_4$ alkyl celluloses and $C_4$ hydroxyalkyl celluloses, see U.S. Pat. No. 4,000,093, issued Dec. 28, 1976 to Nicol et al., and the methyl cellulose ethers having an average degree of substitution (methyl) per anhydroglucose unit from about 1.6 to about 2.3 and a solution viscosity of from about 80 to about 120 centipoise measured at 20° C. as a 2% aqueous solution. Such materials are available as METOLOSE SM100® and METOLOSE SM200®, which are the trade names of methyl cellulose ethers manufactured by Shinetsu Kagaku Kogyo KK.

ENZYME—The composition of the invention may further comprise an enzyme. When present in the detergent composition, the enzymes may be present at levels from about 0.00001% to about 2%, from about 0.0001% to about 1% or even from about 0.001% to about 0.5% or 0.02% enzyme protein by weight of the composition.

Examples of suitable enzymes include, but are not limited to, hemicellulases, peroxidases, proteases, cellulases, xylanases, lipases, phospholipases, esterases, cutinases, pectinases, mannanases, pectate lyases, keratinases, reductases, oxidases, phenoloxidases, lipoxygenases, ligninases, pullulanases, tannases, pentosanases, malanases, β-glucanases, arabinosidases, hyaluronidase, chondroitinase, laccase, and amylases, or mixtures thereof.

ENZYME STABILIZERS—Enzymes for use in detergents can be stabilized by various techniques. The enzymes employed herein can be stabilized by the presence of water-soluble sources of calcium and/or magnesium ions in the finished compositions that provide such ions to the enzymes. In case of aqueous compositions comprising protease, a reversible protease inhibitor, such as a boron compound, can be added to further improve stability.

CATALYTIC METAL COMPLEXES—The compositions of the invention may comprise catalytic metal complexes. When present, one type of metal-containing bleach catalyst is a catalyst system comprising a transition metal cation of defined bleach catalytic activity, such as copper, iron, titanium, ruthenium, tungsten, molybdenum, or manganese cations, an auxiliary metal cation having little or no bleach catalytic activity, such as zinc or aluminum cations, and a sequestrate having defined stability constants for the catalytic and auxiliary metal cations, particularly ethylenediaminetetraacetic acid, ethylenediaminetetra(methylenephosphonic acid) and water-soluble salts thereof. Such catalysts are disclosed in U.S. Pat. No. 4,430,243.

If desired, the compositions herein can be catalyzed by means of a manganese compound. Such compounds and levels of use are well known in the art and include, for example, the manganese-based catalysts disclosed in U.S. Pat. No. 5,576,282.

Cobalt bleach catalysts useful herein are known, and are described, for example, in U.S. Pat. No. 5,597,936; U.S. Pat. No. 5,595,967. Such cobalt catalysts are readily prepared by known procedures, such as taught for example in U.S. Pat. No. 5,597,936, and U.S. Pat. No. 5,595,967.

Compositions herein may also suitably include a transition metal complex of ligands such as bispidones (WO 05/042532 A1) and/or macropolycyclic rigid ligands—abbreviated as "MRLs". As a practical matter, and not by way of limitation, the compositions and processes herein can be adjusted to provide on the order of at least one part per hundred million of the active MRL species in the aqueous washing medium, and will typically provide from about 0.005 ppm to about 25 ppm, from about 0.05 ppm to about 10 ppm, or even from about 0.1 ppm to about 5 ppm, of the MRL in the wash liquor.

Suitable transition-metals in the instant transition-metal bleach catalyst include, for example, manganese, iron and chromium. Suitable MRLs include 5,12-diethyl-1,5,8,12-tetraazabicyclo[6.6.2]hexadecane.

Suitable transition metal MRLs are readily prepared by known procedures, such as taught for example in WO 00/32601, and U.S. Pat. No. 6,225,464.

SOFTENING SYSTEM—the compositions of the invention may comprise a softening agent such as clay for softening through the wash. The composition may additionally comprise a charged polymeric fabric-softening boosting component.

COLORANT—the compositions of the invention may comprise a colorant, typically a dye or a pigment. Particularly, preferred dyes are those which are destroyed by oxidation during a laundry wash cycle. To ensure that the dye does not decompose during storage it is preferable for the dye to be stable at temperatures up to 40° C. The stability of the dye in the composition can be increased by ensuring that the water content of the composition is as low as possible. If possible, the dyes or pigments should not bind to or react with textile fibres. If the colorant does react with textile fibres, the colour imparted to the textiles should be destroyed by reaction with the oxidants present in laundry wash liquor. This is to avoid coloration of the textiles, especially over several washes. Particularly, preferred dyes include but are not limited to Basacid® Green 970 from BASF and Monastral blue from Albion.

Detergent Composition

The detergent composition is typically a laundry detergent composition.

The detergent composition may lead to suds with an improved creaminess.

The detergent composition may comprise a solvent. Suitable solvents include water and other solvents such as lipophilic fluids. Examples of suitable lipophilic fluids include siloxanes, other silicones, hydrocarbons, glycol ethers, glycerine derivatives such as glycerine ethers, perfluorinated amines, perfluorinated and hydrofluoroether solvents, low-volatility nonfluorinated organic solvents, diol solvents, other environmentally-friendly solvents and mixtures thereof.

The detergent composition is for example in particulate form, typically in free-flowing particulate form, although the composition may be in any liquid or solid form. The composition in solid form can be in the form of an agglomerate, granule, flake, extrudate, bar, tablet or any combination thereof. The solid composition can be made by methods such as dry-mixing, agglomerating, compaction, spray drying, pan-granulation, spheronization or any combination thereof. The solid composition typically has a bulk density of from 300 g/l to 1,500 g/l, typically from 500 g/l to 1,000 g/l.

Typically, when the detergent composition of the invention is in particulate form, the detergent composition comprises discrete particulate components comprising both the alkyl sulphate surfactant(s) and the non-sulphated anionic surfactant(s). The composition may comprise spray dried particles comprising both the alkyl sulphate surfactant(s) and the non-sulphated anionic surfactant(s).

In particular, the detergent composition of the invention may be prepared by a process comprising the step of separating from a mixture of alkyl sulphate surfactants of formula $R_2—O—SO_3^-M^+$ comprising less than 85%, in particular less than 80%, by weight of alkyl sulphate surfactant(s) of formula $R_1—O—SO_3^-M^+$, alkyl sulphate(s) of formula $R_2—O—SO_3^-M^+$ comprising from 85% to 100% by weight of alkyl sulphate surfactant(s) of formula $R_1—O—SO_3^-M^+$, wherein $R_2$, $R_1$, and $M^+$ are as defined above.

The detergent composition may also be in the form of a liquid, gel, paste, dispersion, typically a colloidal dispersion or any combination thereof. Liquid compositions typically have a viscosity of from 500 mPa·s to 3,000 mPa·s, when measured at a shear rate of 20 $s^{-1}$ at ambient conditions (20° C. and 1 atmosphere), and typically have a density of from 800 g/l to 1300 g/l. If the composition is in the form of a dispersion, then it will typically have a volume average particle size of from 1 micrometer to 5,000 micrometers, typically from 1 micrometer to 50 micrometers. Typically, a Coulter Multisizer is used to measure the volume average particle size of a dispersion.

The detergent composition may be in unit dose form, including not only tablets, but also unit dose pouches wherein the composition is at least partially enclosed, typically completely enclosed, by a film such as a polyvinyl alcohol film.

The detergent composition may also be in the form of an insoluble substrate, for example a non-woven sheet, impregnated with detergent actives.

The detergent composition may be capable of cleaning and/or softening fabric during a laundering process. Typically, the detergent composition is formulated for use in an automatic washing machine or for hand-washing use.

The following examples are given by way of illustration only and therefore should not be construed to limit the scope of the invention.

EXAMPLES

| Ingredients | Example 1 | Example 2 | Example 3 | Example 4 |
|---|---|---|---|---|
| | Concentration (weight percentage) | | | |
| LAS (Non-sulphated anionic surfactant) | 12 | 15-18 | 9 | 8-25 |
| Mixture of alkyl sulphate surfactants[1] | 1.5 | 1.5-2 | 1.5 | 0.5-10 |
| Cationic surfactant | 0-1 | 0-1.5 | 0-1 | 0-2 |
| Non ionic surfactant | 0-1 | 0-1.5 | 0-1 | 0-5 |
| Phosphate builder(s) | 0-3 | 2-5 | 3 | 0-25 |
| Zeolite | 0-3 | 6-10 | 0-3 | 0-20 |
| Polymeric dispersing or soil release agent(s) | 1-3 | 1-4 | 1-3 | 0-5 |
| Bleach and bleach activator | 0-5 | 4-6 | 2-3 | 0-5 |
| silicate | 7-9 | | 5-6 | 0-5 |
| carbonate | 10-30 | 25-35 | 15-30 | 5-10 |
| Sulfate | 30-70 | 30-35 | 40-70 | 10-70 |

[1]a mixture of alkyl sulphate surfactant having one of the two following chain length distribution (weight percentage):

| | C12 | C14 | C16 | C18/higher |
|---|---|---|---|---|
| Mixture 1 | 65% | 25% | 7% | 3% |
| Mixture 2 | 70% | 30% | | |

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A detergent composition comprising:

a non-sulphated anionic surfactant; and at least one alkyl sulphate surfactant, each alkyl sulphate surfactant in the detergent composition consisting of molecules having formula $R_2$—O—$SO_3^-M^+$, such that from 85% to 100% by weight of said molecules having formula $R_2$—O—$SO_3^-M^+$ are molecules having formula $R_1$—O—$SO_3^-M^+$, where:

each $R_1$ is a linear or branched, substituted or unsubstituted, optionally alkoxylated $C_6$-$C_{14}$ alkyl group;

each $R_2$ is a linear or branched, substituted or unsubstituted, optionally alkoxylated $C_6$-$C_{18}$ alkyl group; and each $M^+$ is a proton or a cation, such that the proton or the cation provides charge neutrality to each alkyl sulphate surfactant.

2. The detergent composition of claim 1, wherein from 60% to 95% by weight of the molecules having formula $R_2$—O—$SO_3^-M^+$ are molecules of formula $R_{12}$—O—$SO_3^-M^+$, where each $R_{12}$ is a $C_{12}$ alkyl group.

3. The detergent composition of claim 1, wherein from 20% to 50% by weight of the molecules having formula $R_2$—O—$SO_3^-M^+$ are molecules of formula $R_{14}$—O—$SO_3^-M^+$, where each $R_{14}$ is a $C_{14}$ alkyl group.

4. The detergent composition of claim 1, wherein the weight ratio of alkyl sulphate surfactant to non-sulphated anionic surfactant in the detergent composition is from about 0.05:1 to about 0.5:1.

5. A detergent composition comprising:

from 8% to 25% by weight, based on the weight of the detergent composition, of a non-sulphated anionic surfactant; and from 0.5% to 10% by weight, based on the weight of the detergent composition, of at least one alkyl sulphate surfactant, each alkyl sulphate surfactant in the detergent composition consisting of molecules having formula $R_2$-—O—$SO_3^-M^+$, such that:

from 85% to 100% by weight of said molecules having formula $R_2$—O—$SO_3^-M^+$ are molecules having formula $R_1$—O—$SO_3^-M^+$, and from 60% to 95% by weight of the molecules having formula $R_2$—O—$SO_3^-M^+$ are molecules of formula $R_{12}$—O—$SO_3^-M^+$, where:

each $R_1$ is a linear or branched, substituted or unsubstituted, optionally alkoxylated $C_6$-$C_{14}$ alkyl group;

each $R_2$ is a linear or branched, substituted or unsubstituted, optionally alkoxylated $C_6$-$C_{18}$ alkyl group;

each $R_{12}$ is a $C_{12}$ alkyl group; and each $M^+$ is a proton or a cation, such that the proton or the cation provides charge neutrality to the alkyl sulphate surfactant.

6. The detergent composition of claim 5, wherein substantially 100% of the groups $R_2$ in the molecules having formula $R_2$—O—$SO_3^-M^+$ are alkyl chains having an even number of carbon atoms.

7. The detergent composition of claim 5, wherein:

from 65% to 70% by weight of the molecules having formula $R_2$—O—$SO_3^-M^+$ are molecules of formula $R_{12}$—O—$SO_3^-M^+$; and from 25% to 30% by weight of the molecules having formula $R_2$—O—$SO_3^-M^+$ are molecules of formula $R_{14}$—O—$SO_3^-M^+$, where each $R_{14}$ is a linear or branched, substituted or unsubstituted, optionally alkoxylated $C_{14}$ alkyl group.

8. The detergent composition of claim 7, wherein:

70% by weight of the molecules having formula $R_2$—O—$SO_3^-M^+$ are molecules of formula $R_{12}$—O—$SO_3^-M^+$, and 30% by weight of the molecules having formula $R_2$—O—$SO_3^-M^+$ are molecules of formula $R_{14}$—O—$SO_3^-M^+$.

9. The detergent composition of claim 7, wherein:

65% by weight of the molecules having formula $R_2$—O—$SO_3^-M^+$ are molecules of formula $R_{12}$—O—$SO_3^-M^+$;

25% by weight of the molecules having formula $R_2$—O—$SO_3^-M^+$ are molecules of formula $R_{14}$—O—$SO_3^-M^+$;

7% by weight of the molecules having formula $R_2$—O—$SO_3^-M^+$ are molecules of formula $R_{16}$—O—$SO_3^-M^+$, where each $R_{16}$ is a linear or branched, substituted or unsubstituted, optionally alkoxylated $C_{16}$ alkyl group; and 3% by weight of the molecules having formula $R_2$—O—$SO_3^-M^+$ are molecules of formula $R_{18}$—O—$SO_3^-M^+$, where each $R_{18}$ is a linear or branched, substituted or unsubstituted, optionally alkoxylated $C_{18}$ alkyl group.

10. The detergent composition of claim 5, wherein said non-sulphated anionic surfactant consists of molecules having alkyl chains with carbon chain lengths from 8 to 18.

11. The detergent composition of claim 10, wherein the at least one alkyl sulphate surfactant has a first average carbon chain length, the non-sulphated anionic surfactant has a second average carbon chain length, and the difference between the first average carbon chain length and the second average carbon chain length is from 0 to 4.

12. The detergent composition of claim 11, wherein the difference between the first average carbon chain length and the second average carbon chain length is from 0 to 2.

13. The detergent composition of claim 5, wherein said non-sulphated anionic surfactant consists of molecules having alkyl chains with carbon chain lengths from 10 to 15.

14. The detergent composition of claim 13, wherein the non-sulphated anionic surfactant is an alkyl benzene sulphonate.

15. The detergent composition of claim 14, wherein the at least one alkyl sulphate surfactant has a first average carbon chain length, the non-sulphated anionic surfactant has a second average carbon chain length, and the difference between the first average carbon chain length and the second average carbon chain length is from 0 to 1.

16. The detergent composition of claim 15, wherein said non-sulphated anionic surfactant consists of molecules having alkyl chains with carbon chain lengths from 11 to 13.

17. The detergent composition of claim 5, wherein a total of from 10% to 99% by weight of all alkyl sulfate surfactants in the detergent composition are alkoxylated alkyl sulfate surfactants.

18. The detergent composition of claim 17, wherein said at least one alkyl sulfate surfactant comprises at least two alkoxylated alkyl sulfate surfactants having different degrees of alkoxylation.

19. The detergent composition of claim 18, wherein said at least two alkoxylated alkyl sulfate surfactants each are alkoxylated with from 0.3 to 1.5 moles of $C_{1-4}$ alkylene oxide per mole of alkyl sulfate surfactant.

20. The detergent composition of claim 5, further comprising from 1% to 20% by weight, based on the weight of the detergent composition, of one or more builder selected from the group consisting of zeolite builders, phosphate builders, and aluminosilicate builders.

* * * * *